United States Patent [19]

Bauch et al.

[11] Patent Number: 4,798,338

[45] Date of Patent: Jan. 17, 1989

[54] APPARATUS FOR THE ELECTRO-KINETIC CHARGING OF POWDERED MATERIALS

[75] Inventors: Helmut Bauch; Wolfgang Kleber; Dieter Auerbach, all of Dresden, German Democratic Rep.

[73] Assignee: VEB Infrarot-Anlagen Oranienburg, Oranienburg, German Democratic Rep.

[21] Appl. No.: 939,257

[22] Filed: Dec. 5, 1986

Related U.S. Application Data

[63] Continuation of Ser. No. 691,805, Jan. 15, 1985, abandoned.

[30] Foreign Application Priority Data

Feb. 8, 1984 [DD] German Democratic Rep. ..... 2599262

[51] Int. Cl.[4] ..... B05B 5/00

[52] U.S. Cl. ..... 239/692; 239/705; 239/706; 239/708

[58] Field of Search ..... 239/690, 641, 697, 698, 239/704–708, 3

[56] References Cited

U.S. PATENT DOCUMENTS

| | | | |
|---|---|---|---|
| 3,317,138 | 5/1967 | Fraser | 239/697 |
| 3,819,115 | 6/1974 | Soderman | 239/698 |
| 3,903,321 | 9/1975 | Schaad | 239/698 X |
| 3,905,330 | 9/1975 | Coffee . | |
| 3,938,739 | 2/1976 | Bertilsson et al. | 239/705 |
| 4,090,666 | 5/1978 | Peck | 239/692 |
| 4,289,278 | 9/1981 | Itoh | 239/706 |
| 4,316,582 | 2/1982 | Kobayashi et al. | 239/704 X |
| 4,324,361 | 4/1982 | Moos et al. | 239/706 X |
| 4,417,696 | 11/1983 | Kako et al. | 239/690 |
| 4,659,019 | 4/1987 | Talacko | 239/692 |

FOREIGN PATENT DOCUMENTS

| | | | |
|---|---|---|---|
| 1577757 | 1/1971 | Fed. Rep. of Germany . | |
| 2209231 | 10/1972 | Fed. Rep. of Germany . | |
| 2203351 | 8/1973 | Fed. Rep. of Germany . | |
| 2451514 | 5/1975 | Fed. Rep. of Germany . | |
| 2713697 | 10/1977 | Fed. Rep. of Germany . | |
| 2756009 | 6/1979 | Fed. Rep. of Germany . | |
| 2938606 | 4/1980 | Fed. Rep. of Germany . | |
| 3100002 | 11/1981 | Fed. Rep. of Germany . | |
| 3303137 | 8/1983 | Fed. Rep. of Germany . | |
| 113289 | 6/1975 | German Democratic Rep. . | |
| 106308 | 10/1976 | German Democratic Rep. . | |
| 134841 | 3/1979 | German Democratic Rep. . | |
| 2018625 | 10/1979 | United Kingdom | 239/698 |

*Primary Examiner*—Andres Kashnikow
*Assistant Examiner*—Patrick M. Burkhart
*Attorney, Agent, or Firm*—Schweitzer & Cornman

[57] ABSTRACT

An apparatus for the electro-kinetic charging of powder-like materials having a pair of supply channels, an input zone for each channel, one for the powder dispersed in a gas flow and one for another gas flow and which are shaped as dual annular nozzles with a pipe-shaped separating wall therebetween acting as an electrostatic ionizing electrode and made from an electrically semiconductive material having anti-sticking properties and, wherein the adjoining flow channel is formed as an annular channel by a pipe from an insulating material, and a centrally arranged rod, wherein the ratio between rod and pipe diameters is on the range from 0.75 to 0.9.

6 Claims, 1 Drawing Sheet

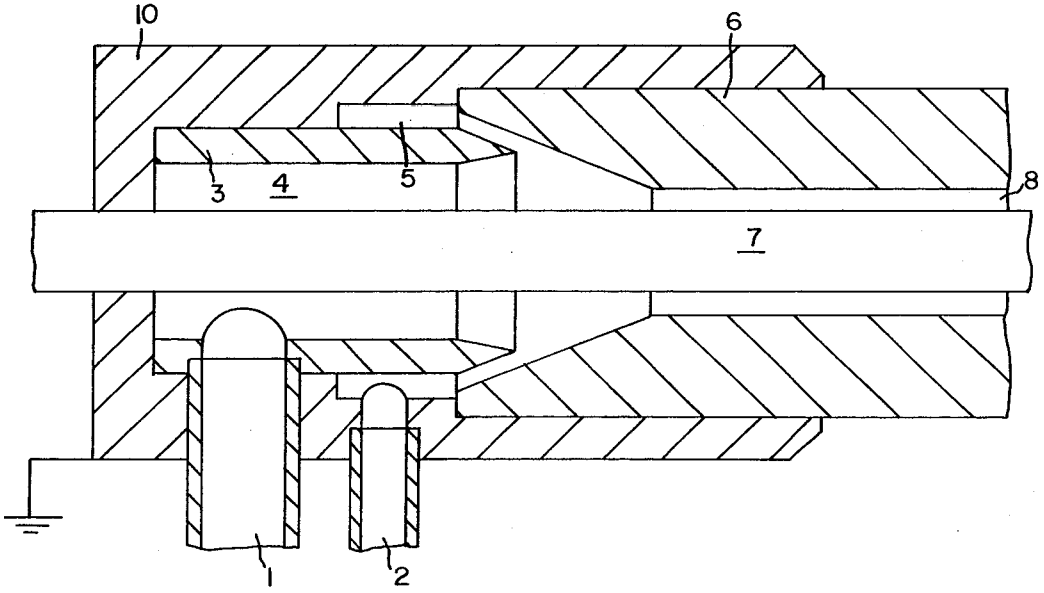
8
6
7
5
4
3
10
2
1

APPARATUS FOR THE ELECTRO-KINETIC CHARGING OF POWDERED MATERIALS

This is a continuing application of application Ser. No. 691,805, filed on Jan. 15, 1985, abandoned.

FIELD AND BACKGROUND OF THE INVENTION

The present invention relates to an apparatus for the electro-kinetic charging of powder-like materials for the purpose of electrostatic coating of objects with such powder. It can be used in manual as well as automatically operated powder spray devices, also in fluidized bed apparatus, as a charging device. For the coating material one may use duro or thermoplastic powders, enamel or similar materials in powder form.

There are spray apparatus known for the electrostatic surface coating, in which the powdered coating material while being pneumatically forced through an insulating material channel, becomes electrically charged through the frictional effect due to the fact that the powder particles contact the wall of the flow channel (for example, German Patent No. 1,577,757 and 2,203,351).

The disadvantage of such apparatus resides in that it can be operated only with a relatively low powder output to accomplish an intensive all-around contact of the powder particles with the flow-through channel to obtain a charge which is satisfactory from the viewpoint of the technical requirement of the process. In order to increase the powder charging, various measures have been undertaken, which were intended to increase the turbulence of the flow, and to this effect special turbulence creating means have been inserted (German Laid-Open Application No. 2,938,606), also propellers, (U.S. Pat. No. 3,905,330) or a blower (German Laid-Open Application No. 2,209,231) and curved charging pipes (German Laid-Open Application No. 3,100,002). Furthermore, there are constructive variants known, in which by means of a half-toroid-shaped input section under the use of the Coanda effect (German Laid-Open Application No. 2,713,697) or by means of producing a helical-shaped particle path (German Laid-Open Application No. 2,756,009) an intensive wall contact is accomplished.

Furthermore, there are electro-kinetic charging devices known, in which the charging of the powder is accomplished by a combination of a frictional-electric effect with the ionization process caused by it on passive electrostatic electrodes (East German Patent Nos. 106,308 and 113,289 and German Laid-Open Application No. 3,303,137). According to the latter publications, the pneumatically introduced powder is undergoing a turbulence effect in an insulating material pipe caused by a gas flow. The device is in the form of a jet apparatus and includes a pair of input channels meeting in the starting section of the insulating mateial channel and, in the region of the combined gas flow, one or more electrostatic ionizing electrodes are provided. Such electrodes are in the form of rings embedded into the inner wall of the insulating material pipe or, in the form of axially or radially projecting needle electrodes projecting into the insulating pipe.

There is also a device known in which in the direction of the flow, behind or in the immediate vicinity of the electrostatic ionizing electrode, a cone-shaped flow-member is arranged for the increasing of the frictional electrical effect (East German Patent No. 134,841). All the devices which operate with an additional gas flow have one feature in common, namely, that they operate on the principle of a jet apparatus, whereby the uniform nature of the powder-gas flow introduced by a hose conduit and through an ejector, becomes effected. The devices having the electrostatic ionizing electrodes possess the disadvantage that the ionization process occurs on certain preferred points and, on these points, due to the partially high field strengths as a result of the glow discharge, the powder particles will become sintered or melted onto the electrodes, whereupon the ionization becomes reduced and, the powder charging falls-off. The electrostatic electrodes, therefore, must undergo a removal of the powder crust developed on them after certain period of time.

SUMMARY OF THE INVENTION

It is the object of the present invention to improve the functional reliability of a powder coating apparatus operating with electro-kinetic charging, by providing a more uniform powder output, as well as an increased and more stable powder charging, along with the reduction of the cleaning requirement and, as a result, to increase the scope of application of the electro-kinetic powder coating apparatus.

It is another object of the invention to prevent the crust formation on the electrostatic electrodes by improving the shape of the input zone and, by an appropriate input of the materials, as well as to increase the intensity of the charging process.

According to the invention, such object is solved by providing an input zone for each of a pair of supply channels in one of which the powder dispersed in a gas flow is flowing and, in the other, a further gas flow is introduced, which input zone is in the form of a dual annular nozzle, and wherein through the inner channel the powder gas flow and, through the outer annular gap, the second gas flow is introduced and, according to which, a pipe-like separating wall acting as the passive electrostatic ionizing electrode is the separating wall between the two channels. It is made from an electrically semiconductive material having anti-sticking properties and is, directly or indirectly through a measuring and/or control device, connected to ground potential and, the next adjacent flow channel is formed as an annular channel from an insulating material. Expecially suitable is an embodiment, in which the electrostatic ionizing electrode is made from a material which has a specific volume resistance of $10^4 \ldots 10^8$ Ωm.

Polytetrafluoraethylene has been found especially suitable with a graphite content of 10–25%.

As a further suitable embodiment for the pipe-like electrostatic electrode, an insulating material with semiconductive conductive coating on its outer surface has been found, which has a specific upper surface resistance of $10^6 \ldots 10^9$ ohm (measured with a pair of cutting electrodes having a length of 10 cm and spaced 1 cm from each other).

In a preferred embodiment of the invention the outer annular-shaped supply channel for the gas flow will taper in a conical fashion, and wherein the generating surface of the channel wall encloses an angle of 5°–30° with respect to the axis of the pipe.

The channel made from an insulating material and, which is adjoining the input zone, is made preferably from a pipe and a central rod, wherein the ratio of the rod diameter to the diameter of the pipe is in the range of 0.75–0.9, that is, the numbers 0.75 and 0.9 each represents a ratio.

BRIEF DESCRIPTION OF THE DRAWING

The invention will be described in the following on hand of an embodiment. The attached drawing illustrates in sectional view the charging device according to the invention.

DESCRIPTION OF THE PREFERRED EMBODIMENT

Through an input channel 1 which terminates in an inner annular shaped chamber 4 surrounded by an electrostatic electrode 3, a powder is dispersed in the supply gas and coming from a supply container is introduced by means of an ejector. An input channel 2 for a second gas flow is terminating in the outer annular chamber 5.

A pipe-shaped separating wall between the two annular chambers forms the electrostatic electrode 3. According to the invention it is made from a material having anti-sticking properties and having a specific volume resistance of $10^4$–$10^8$ Ωm. Especially suitable is polytetrafluoraethylene having an additive of pb 10–25% graphite. The front portion of the electrostatic electrode is formed in an edge shape. While the inner wall is tapering outwardly, the outer wall is tapering inwardly.

The adjoining flow channel 1 is made from a pipe of insulating material 6 and has a centrally arranged rod 7 of the same material therein, wherein the ratio of rod and pipe diameters is in the range of 0.75–0.9.

By employing electrically semiconductive material, it is accomplished that the ionization is very uniform and will be distributed on the front edge. The gas flowing through the annular gap which is tapering in a conical fahsion, will cause a removal of the powder-gas flow from the edges of the electrostatic electrode. As a result, the region of high field strength in front of the ring shaped electrode edge, will be free from powder particles, so that the ionization process (glow or corona discharge) will occur in pure gas and, melting on or sintering of powder particles will be prevented. This effect will further be supported by the anti-sticking properties of the polytetrafluoraethylene.

The annular gap-like form of the adjoining flow channel in which very strong electro-kinetic effects will occur due to the combined effect of the two streams having different speeds, will accomplish a very high powder charging as a result of the cooperation between the wall material and the constructive shape of the electrostatic electrode bringing about a uniform distribution of the ionization process and resulting in the aforementioned high powder charging.

It is a further advantage that there will be no undesirable ejector effects which would undesirably influence the uniform nature of the powder charging.

We claim:

1. Apparatus for the electro-kinetic charging of a powder, which comprises a housing, a first input channel for the introduction of the powder dispersed in a gas flow, a second input channel for the introduction of another gas flow, a central rod of an insulating material extending throughout the length of the apparatus, a semiconducting annular electrode having anti-sticking properties for generating passive electrostatic ionization and having a conical edge-shaped end and an inner and an outer surface and being connected from ground potential, said semiconductive annular electrode being disposed about said central rod and defining a first annular chamber between the inner surface of said semiconductive annular electrode and said central rod, the first input channel terminating in said first annular chamber, said housing and the outer surface of said semiconductive annular electrode defining a second annular chamber therebetween, said second input channel terminating in said second annular chamber, said first and second annular chambers merging with each other past the edge-shaped end of said semiconductive annular electrode, a pipe of an insulating material disposed concentrically about said central rod, and defining an annular flow channel between the central rod and said pipe, one end of said annular flow channel being disposed adjoining the terminations of said first and second annular chambers.

2. The apparatus of claim 1, wherein said semiconductive annular electrode is of a material having a specific volume resistance of from about $10^4$ to about $10^8$ Ωm.

3. The apparatus of claim 2, wherein the semiconducting annular electrode is made from an insulating material and is provided with a semiconducting outer coating having a specific surface resistance of from about $10^6$ to about $10^9$ Ω.

4. The apparatus of claim 1, wherein the pipe forming said flow channel with the central rod, is of an insulating material, the end of said pipe facing said second annular chamber forms a tapering termination for said chamber, said tapering being disposed at an angle of from about 5° to about 30° with respect to the central rod.

5. The apparatus of claim 4, wherein the conical bore within the pipe of insulating material continues outwardly from the apparatus parallel to the central rod and the ratios of the rod diameter to the inside diameter of the pipe are from 0.75 to 0.9.

6. Apparatus for the electro-kinetic charging of powdered material, which comprises a first input channel for the introduction of a powder dispersed in a gas flow into a first annular chamber, a second input channel for the introduction of another gas flow into a second annular chamber that is concentric with said first annular chamber, a semiconducting annular electrode connected from ground potential and having a conical end tapering into an edge-shaped tip, said semiconducting annular electrode concentrically separating said first and said second annular chambers from each other, said first and second annular chambers each terminating and joining each other at said edge-shaped tip of said semiconducting annular electrode, a central rod of an insulator disposed along the longitudinal axis of the apparatus, a pipe of an insulator disposed concentrically about said central rod and defining an annular flow channel between the control rod and the interior surface of the pipe, said annular flow channel adjoining at one end thereof the ends of said first and second annular chambers which terminate in said flow channel, said flow channel conically tapering away from the terminations of said first and second annular chambers at the conically tapering end of said semiconductive annular electrode.

* * * * *